US011337514B2

(12) United States Patent
Summerville

(10) Patent No.: US 11,337,514 B2
(45) **Date of Patent: *May 24, 2022**

(54) MODULAR CONFERENCE TABLE

(71) Applicant: Regency Seating, Inc., Akron, OH (US)

(72) Inventor: Aaron Summerville, Canal Fulton, OH (US)

(73) Assignee: Regency Seating, Inc., Akron, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/158,224

(22) Filed: Jan. 26, 2021

(65) Prior Publication Data

US 2021/0169213 A1 Jun. 10, 2021

Related U.S. Application Data

(63) Continuation of application No. 16/170,397, filed on Oct. 25, 2018, now Pat. No. 10,905,230, which is a continuation of application No. 14/530,216, filed on Oct. 31, 2014, now abandoned, which is a continuation of application No. 13/346,779, filed on Jan. 10, 2012, now Pat. No. 8,875,639.

(60) Provisional application No. 61/471,404, filed on Apr. 4, 2011.

(51) Int. Cl.

| | |
|---|---|
| ***A47B 1/03*** | (2006.01) |
| ***A47B 1/04*** | (2006.01) |
| ***A47B 13/08*** | (2006.01) |
| ***A47B 3/06*** | (2006.01) |

(52) U.S. Cl.

CPC ..... *A47B 1/03* (2013.01); *A47B 1/04* (2013.01); *A47B 3/06* (2013.01); *A47B 13/08* (2013.01); *A47B 13/088* (2013.01); *A47B 2200/0079* (2013.01); *A47B 2200/12* (2013.01); *Y10T 29/49826* (2015.01)

(58) Field of Classification Search

CPC ..... A47B 1/03; A47B 1/04; A47B 2200/0079; A47B 2200/12; Y10T 29/49826

USPC ..... 108/64, 65, 50.01, 50.02, 83–89, 153.1, 108/155; 312/194–196, 223.3

See application file for complete search history.

(56) References Cited

U.S. PATENT DOCUMENTS

| | | | |
|---|---|---|---|
| 1,225,234 | A | 5/1917 | Fox |
| D247,080 | S | 1/1978 | Robinson |
| 5,359,944 | A | 11/1994 | Steinbeck |

(Continued)

*Primary Examiner* — Janet M Wilkens

(74) *Attorney, Agent, or Firm* — Edwin A. Sisson, Attorney at Law, LLC; Jeffrey J. Banyas; Edwin A. Sisson

(57) ABSTRACT

A modular conference table allows meeting participants and office staff to quickly and effectively change the length of the conference table as the needs of the meeting participants change. The present invention includes a tabletop assembly including a first end-top, a second end-top, and a modular insert top. Additionally, modular conference table includes a leg assembly upholding the tabletop assembly. The legs assembly includes two terminal supports and center supports. The modular conference table can be expanded in order to accommodate the needs of the user by adding an additional number of modular insert tops, modesty panels, and center supports. Thus, the invention allows attendees of meetings and office staff to adjust the size of a conference table according to the size of the space or the needs of the user.

4 Claims, 15 Drawing Sheets

(56) References Cited

U.S. PATENT DOCUMENTS

| | | | | |
|---|---|---|---|---|
| 5,810,505 | A | 9/1998 | Henriott et al. | |
| D406,748 | S | 3/1999 | Byrne | |
| 5,943,966 | A * | 8/1999 | Machado | A47B 87/002 108/64 |
| 5,947,569 | A | 9/1999 | Rheault et al. | |
| 6,082,838 | A | 7/2000 | Bissu-Palombo | |
| 6,196,648 | B1 | 3/2001 | Henriott | |
| 7,223,045 | B2 | 5/2007 | Migli | |
| 7,516,708 | B2 | 4/2009 | Willy | |
| 8,096,244 | B1 | 1/2012 | Bockheim | |
| 8,272,335 | B2 | 9/2012 | Derocher | |
| 8,875,639 | B2 * | 11/2014 | Summerville | A47B 13/08 108/65 |
| D778,652 | S * | 2/2017 | Siebert | D6/707.15 |
| 10,905,230 | B2 * | 2/2021 | Summerville | A47B 1/04 |
| 2003/0066464 | A1 * | 4/2003 | Chang | A47B 17/065 108/103 |
| 2003/0070595 | A1 | 4/2003 | Crinion | |
| 2003/0089283 | A1 | 5/2003 | Okamoto et al. | |
| 2004/0089283 | A1 | 5/2004 | Pedersen | |
| 2005/0045073 | A1 * | 3/2005 | Wasley | A47B 87/002 108/64 |
| 2005/0268823 | A1 | 12/2005 | Bakker et al. | |
| 2006/0005747 | A1 | 1/2006 | Cartelli et al. | |
| 2007/0251428 | A1 | 11/2007 | Mead et al. | |
| 2007/0277710 | A1 | 12/2007 | Gray et al. | |
| 2009/0165680 | A1 | 7/2009 | Bakker et al. | |
| 2015/0053121 | A1 * | 2/2015 | Summerville | A47B 1/03 108/60 |

* cited by examiner

MODULAR CONFERENCE TABLE

This continuation application claims priority to a utility patent application Ser. No. 16/170,397 filed 25 Oct. 2018 which is to be granted as U.S. Pat. No. 10,905,230, which claims priority from Ser. No. 14/530,216, filed Oct. 31, 2014, which claims priority to a utility patent application Ser. No. 13/346,779, filed Jan. 10, 2012 which was granted as U.S. Pat. No. 8,875,639 on Nov. 4, 2014, which claims priority to provisional patent application, Ser. No. 61/471,404, filed Apr. 4, 2011, all of which are hereby incorporated by reference. This invention generally relates to methods and apparatuses concerning conference tables and more specifically relates to methods and apparatuses concerning a modular conference table which is expandable and retractable according to the space available.

BACKGROUND

A. Field of Invention

B. Description of the Related Art

It is long known in the art to provide conference tables for group meeting rooms. Manufacturers of conference tables must manufacture different sized tabletops of different lengths to suit the needs of consumers. For example, a manufacturer must manufacture a shorter tabletop for those buyers with a small amount of space in which to accommodate a conference table. Conversely, a manufacturer must manufacture a longer tabletop for those buyers with a larger amount of space in which to accommodate a conference table. However, furniture making and building techniques must advance to efficiently handle differing consumer needs and space availability.

Further, if the number of persons using a conference table changes, the consumer may desire to increase or decrease the size of the conference table. This means that the furniture manufacturers must do more than simply provide a conference table, but must provide a conference table that is expandable and retractable in a user-friendly way. It is still desirable, however, to provide an easy way for meeting participants and office staff to quickly and effectively change the length of the conference table as the needs of the meeting participants change. This will allow attendees of the meetings to adjust the size of a conference table according to the size of the space or the needs of the user.

What is needed, then, is a modular conference table that allows for the easy adjustment of the length of the conference table according to consumer needs and the amount of space available. As a result, the length of the conference table may be adjusted by the addition or removal of inserts which comprise the conference tabletop and by the addition and removal of the center supports.

SUMMARY

According to one embodiment, a modular conference table includes (1) a tabletop assembly including (a) a first end-top, (b) a second end-top and (c) a modular insert top which includes at least one elongated central opening in which a grommet is placed where the modular insert top is interposed between the first and second end-tops to form a singular elongated work surface, (2) a leg assembly upholding the tabletop assembly where the leg assembly includes (a) a first terminal support perpendicularly attached to the first end-top, (b) a second terminal support perpendicularly attached to the second end-top and (c) a center support located between the terminal supports and perpendicularly attached to the modular insert top, and (3) two modesty panels (a) wherein the first modesty panel is interposed between the first terminal support and the center support (b) wherein the second modesty panel is interposed between the second terminal support and the center support and (c) where each modesty panel is perpendicularly attached to the elongated work surface.

According to another embodiment, a modular conference table includes (1) a tabletop assembly including (a) a first end-top, (b) a second end-top and (c) at least two modular insert tops which are aligned with one another to form an inner tabletop assembly where the inner tabletop assembly formed by the modular insert tops is interposed between the first and second end-tops to form an elongated work surface, (2) a leg assembly upholding the tabletop assembly where the leg assembly includes (a) a first terminal support perpendicularly attached to the first end-top, (b) a second terminal support perpendicularly attached to the second end-top and (c) at least two center supports located between the terminal supports and perpendicularly attached to each modular insert top, and (3) at least three modesty panels where each modesty panel is perpendicularly attached to the elongated work surface and (a) where the at least three modesty panels are perpendicularly attached to the elongated work surface and (b) where the at least three modesty panels are also located between the first and second terminal supports.

According to yet another embodiment, a method may comprise the steps of: (A) inserting cam pins, dowel rods, and double cam pins into existing holes in a first and a second terminal support, a first and a second end-top, a first and a second modular insert top, and an alpha, a beta, and a gamma modesty panel; (B) attaching the first and second modular insert tops to one another such that each modular insert top is abutted end-to-end with the other and is aligned to form an inner tabletop assembly and tightening the associated cam locks: (C) attaching the first and second end-tops to opposite ends of the inner tabletop assembly such that the inner table assembly and the first and second end-tops are abutted end-to-end with one another and are aligned to form an elongated work surface; (D) attaching the first center support to the first modular insert top and tightening the associated cam locks; (E) attaching the beta modesty panel to the first center support and the first and second insert tops and tightening the associated cam locks; (F) attaching the second center support to the second insert top and tightening the associated cam locks; (G) attaching the gamma modesty panel to the second center support, the second insert top, the second end-top and tightening the associated cam locks; (H) attaching the second terminal support to the second end-top and the gamma modesty panel and tightening the associated cam locks; (I) attaching the alpha modesty panel to the first center support, the first insert top, and the first end-top and tightening the associated cam locks; (J) attaching the first terminal support to the first end-top and the alpha modesty panel and tightening the associated cam locks.

Many benefits and advantages will become apparent to those skilled in the art to which it pertains upon a reading and understanding of the following detailed specification.

BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

DETAILED DESCRIPTION

Figure 1:
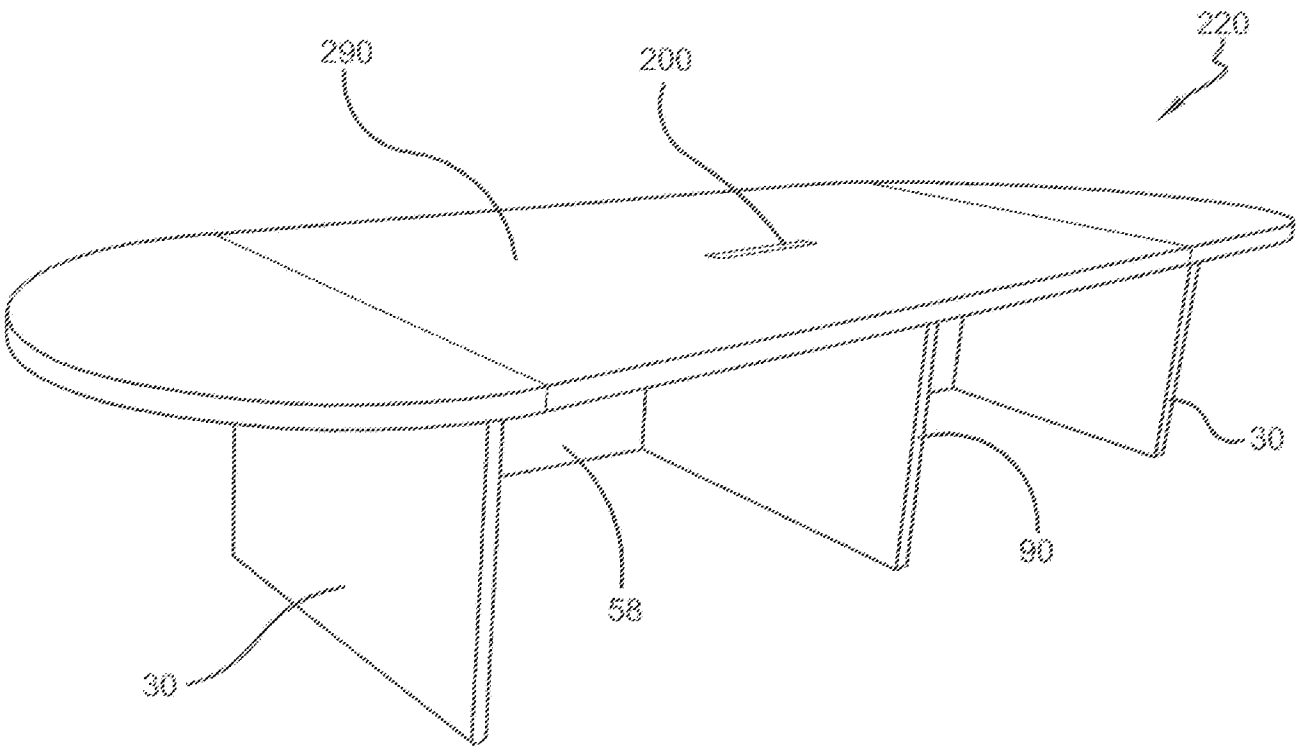
FIG. 1 is a perspective view of the modular conference table.
Figure 2:
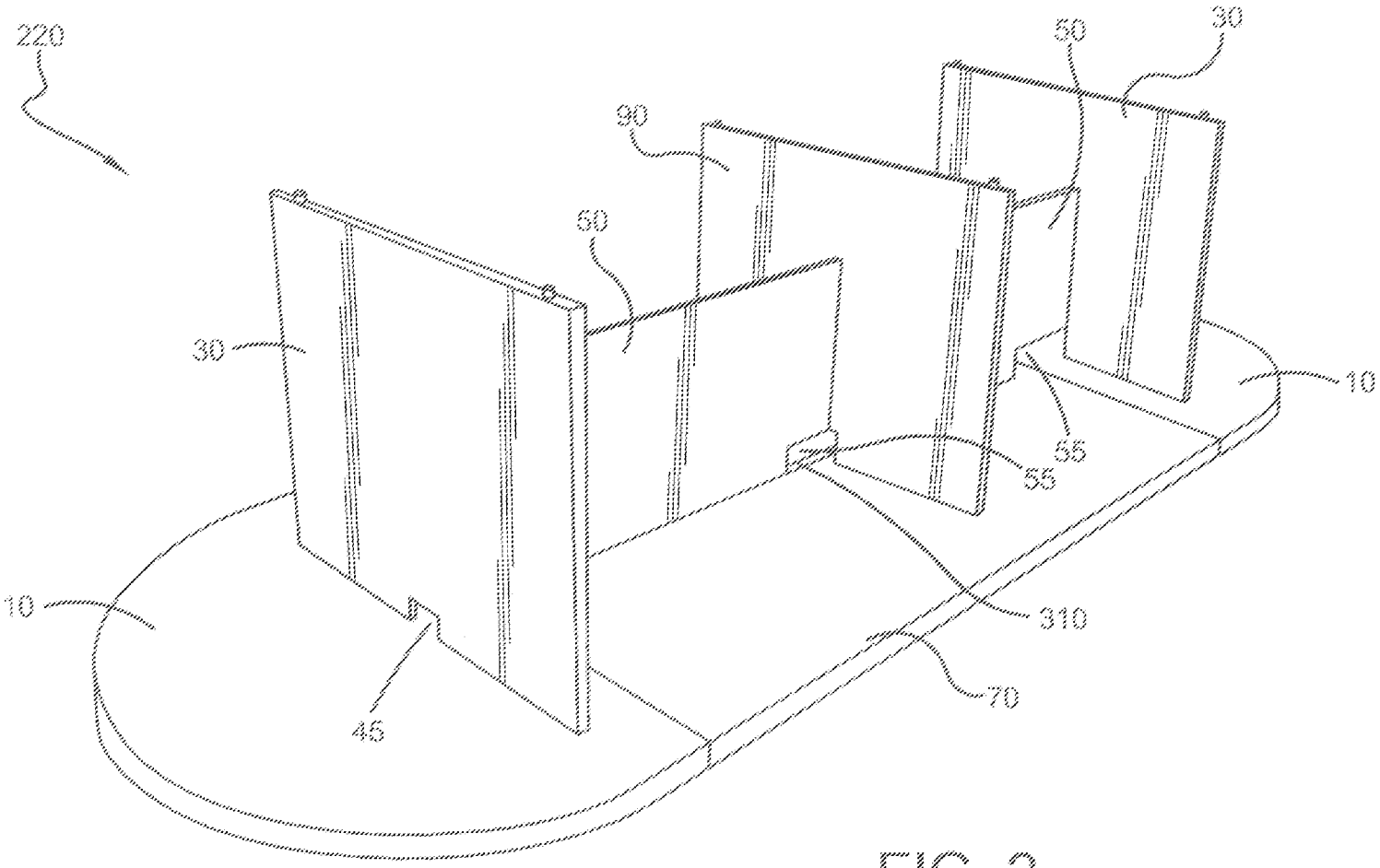
FIG. 2 is perspective view underneath the modular conference table.

Referring now to the drawings wherein the showings are for purposes of illustrating embodiments of the invention only and not for purposes of limiting the same, and wherein like reference numerals are understood to refer to like components, FIG. 1 shows an assembled version of one embodiment, showing table 220, grommet 200, tabletop assembly 290, center support 90, modesty panel 58, and terminal support 30. More details are shown in FIG. 2, which shows the modular conference table 220, along with modular insert top 70 and underside 10 of end-tops 12, 14.

With reference now to FIGS. 1-15, the modular conference table 220 includes a tabletop assembly 290 including a first end-top 12, a second end-top 14, and a modular insert top 70. The modular insert top 70 includes at least one elongated central opening in which a grommet 200 is placed for accessing a utility port (not shown). The modular insert top 70 is interposed between the first and second end-tops 12, 14 to form a singular elongated work surface. Additionally, modular conference table 220 includes a leg assembly upholding the tabletop assembly 290. The leg assembly includes a first terminal support 32 perpendicularly attached to the first end-top 12, a second terminal support 34 perpendicularly attached to the second end-top 14 and a center support 90 interposed between the terminal supports 32, 34 and perpendicularly attached to the modular insert top 70. The modular insert top 70 also includes two modesty panels 50. The alpha modesty panel 52 is interposed between the first terminal support 32 and the center support 90. The beta modesty panel 54 is interposed between the second terminal support 34 and the center support 90. Additionally, each modesty panel 52, 54 is perpendicularly attached to the tabletop assembly 290. Additionally, a flat bracket 330 can be used to reinforce the connection of the end-tops 12, 14, and a power supply 340 can be added to the grommet 200, along with a wire trough 350, which is used to hide the wires 360.

Figure 3:
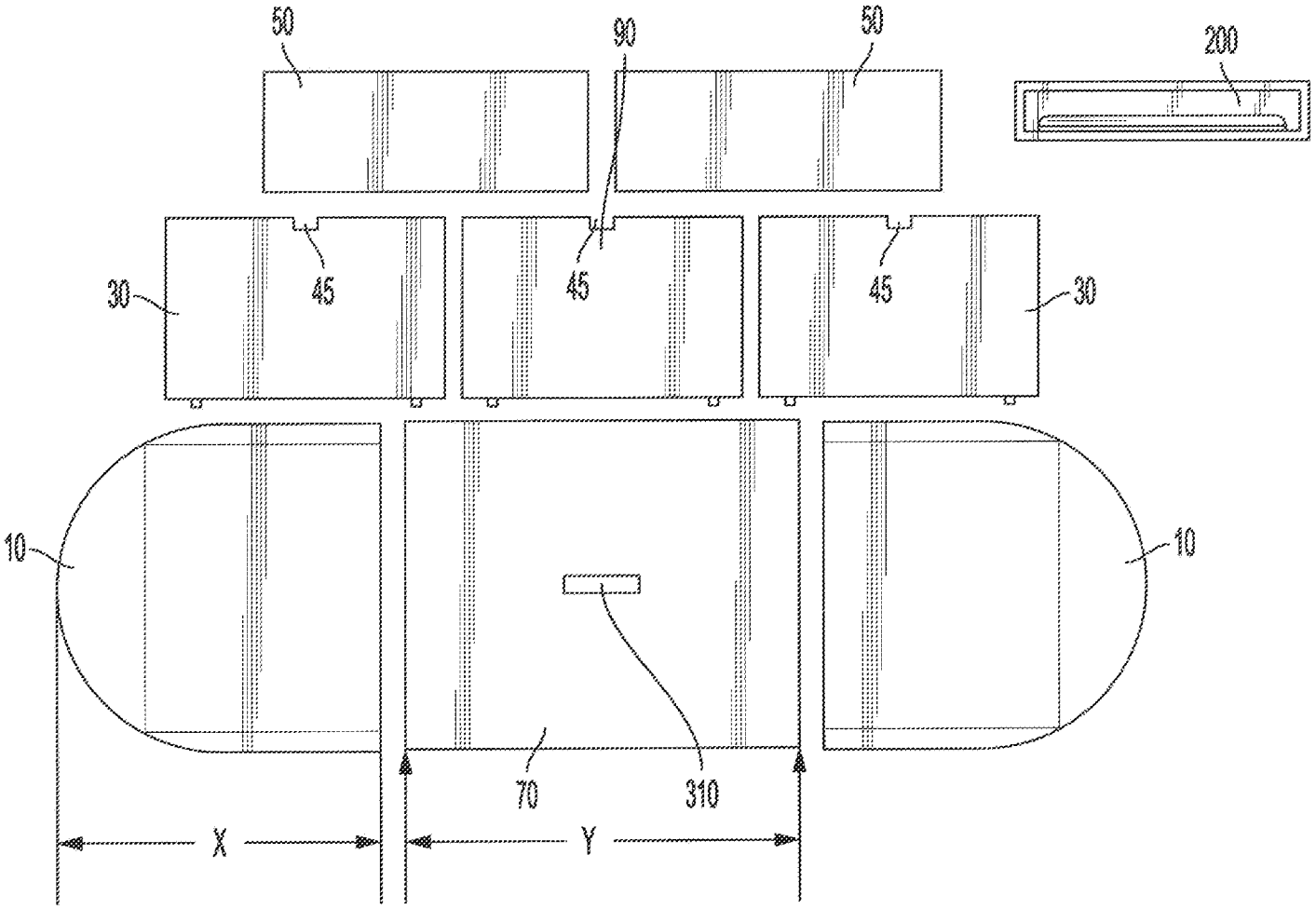
FIG. 3 is an exploded view of the modular conference table.
Figure 4:
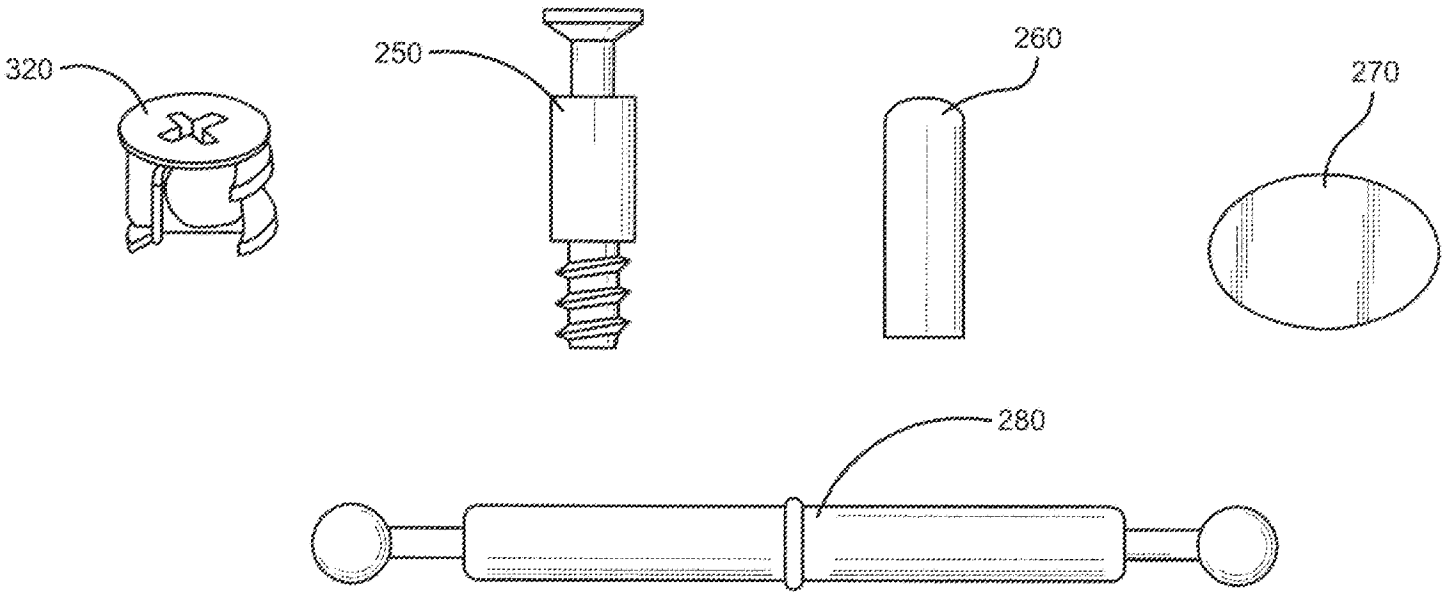
FIG. 4 is a front view of the hardware.
Figure 11:
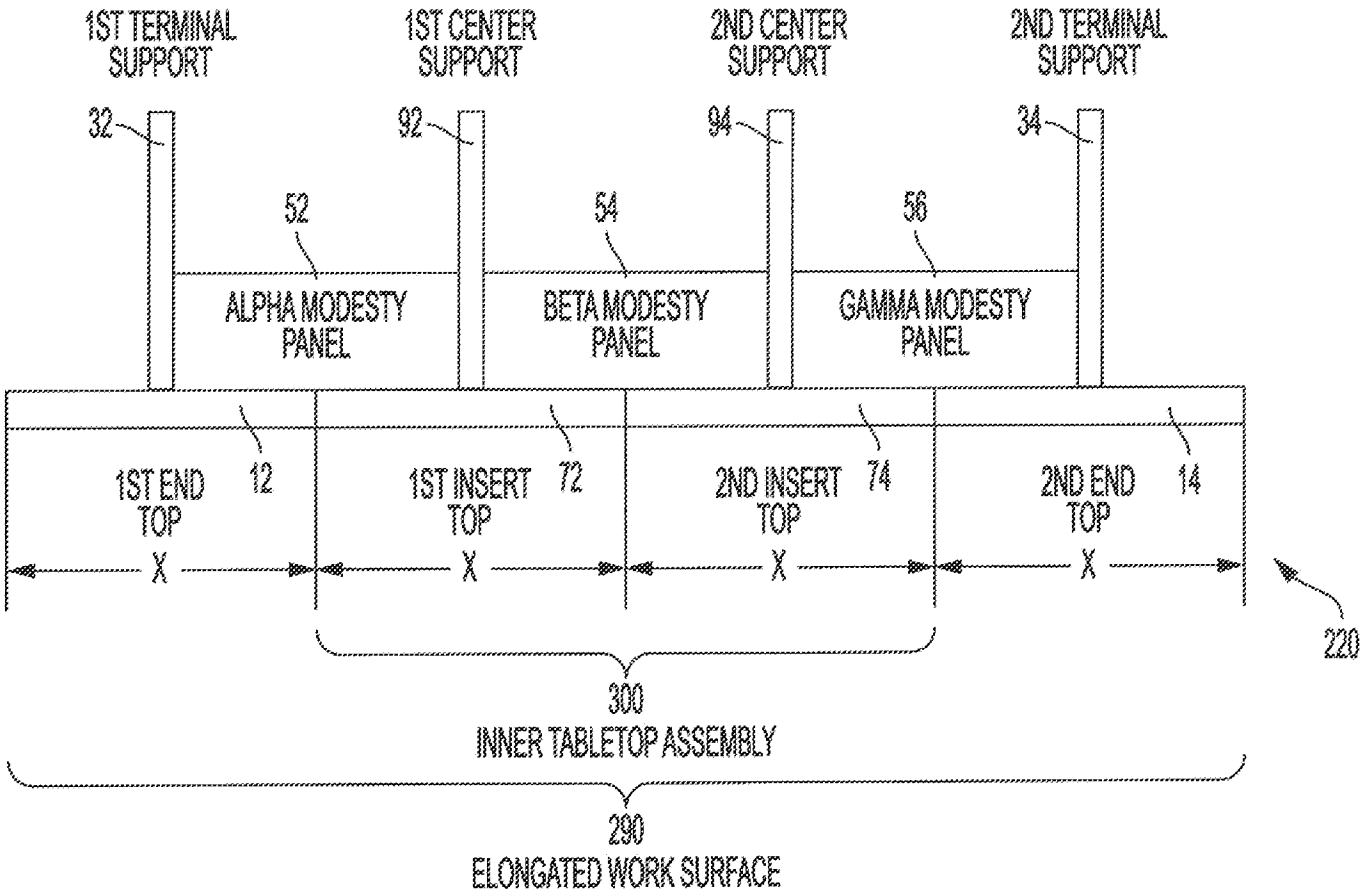
FIG. 11 is a side view of the modular conference table.

With reference now to FIG. 3, the table 220 is shown in an exploded view, showing the shape and relative size of the various components. In FIG. 3, the distance across the end tops are not substantially equal to the distance across the insert top. As shown in FIG. 3, the end tops have a distance across the end top denoted as X. The insert top has a relative distance across the insert top of 1.2X, i.e. a difference of 20%. The relative distance across the insert top is 20% greater than the distance across the end tops. This is to be contrasted with FIG. 11, in which the distance across the end tops are substantially equal to the distances across the insert tops. In FIG. 11, the distances across the end tops are denoted as X, and the distances across the insert tops is also approximately X, i.e. the same or substantially the same value. FIG. 4 shows one embodiment of the hardware that can be used to assembly the table 220. FIG. 4 shows cam pin 250, dowel rod 260, cam cap 270, double cam pin 280, and cam lock 320. It is to be understood, however, that any means of connected the various pieces together can be used, as long as chosen using sound engineering judgment.

Figure 5:
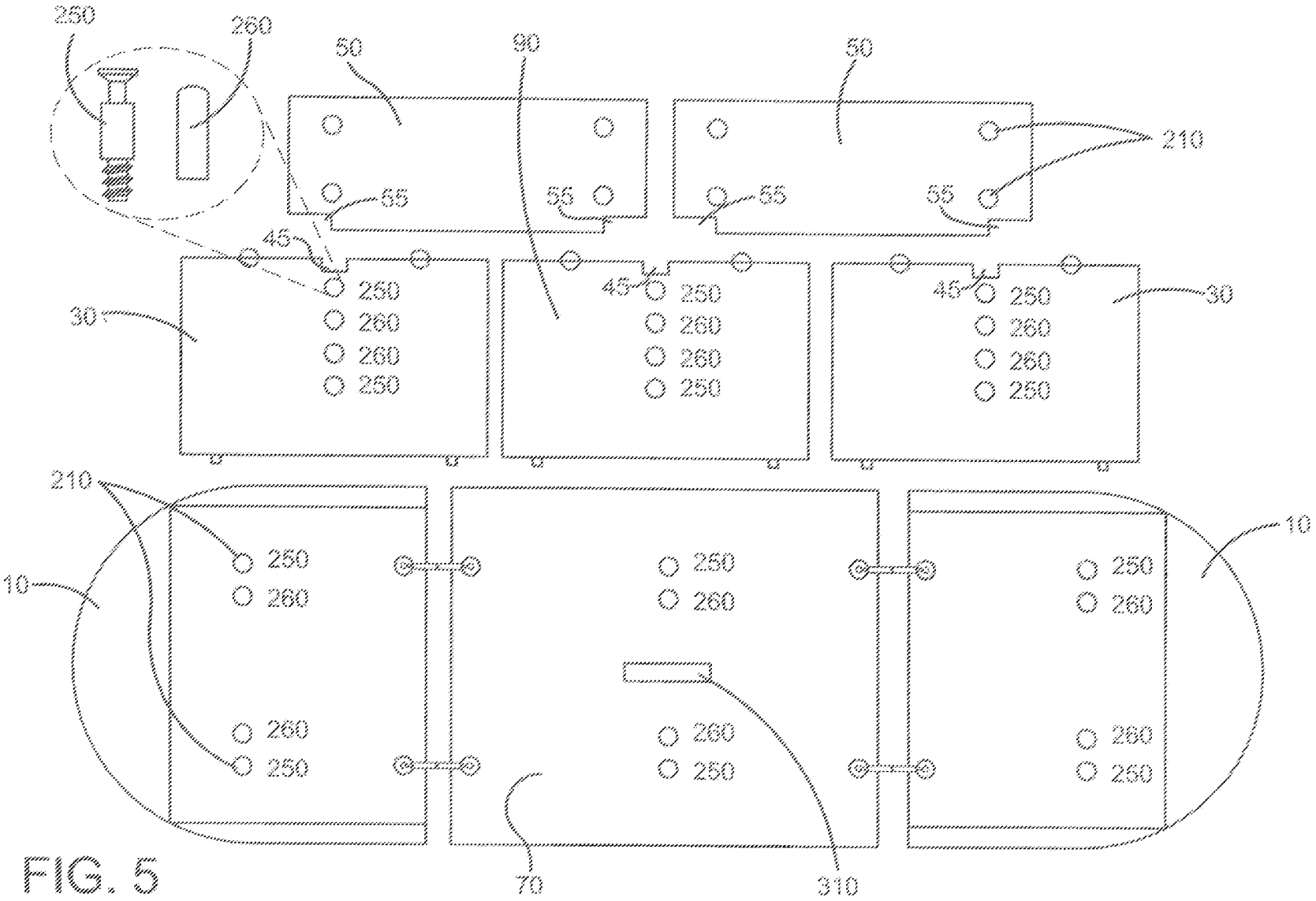
FIG. 5 is an exploded view of the modular conference table.
Figure 6:
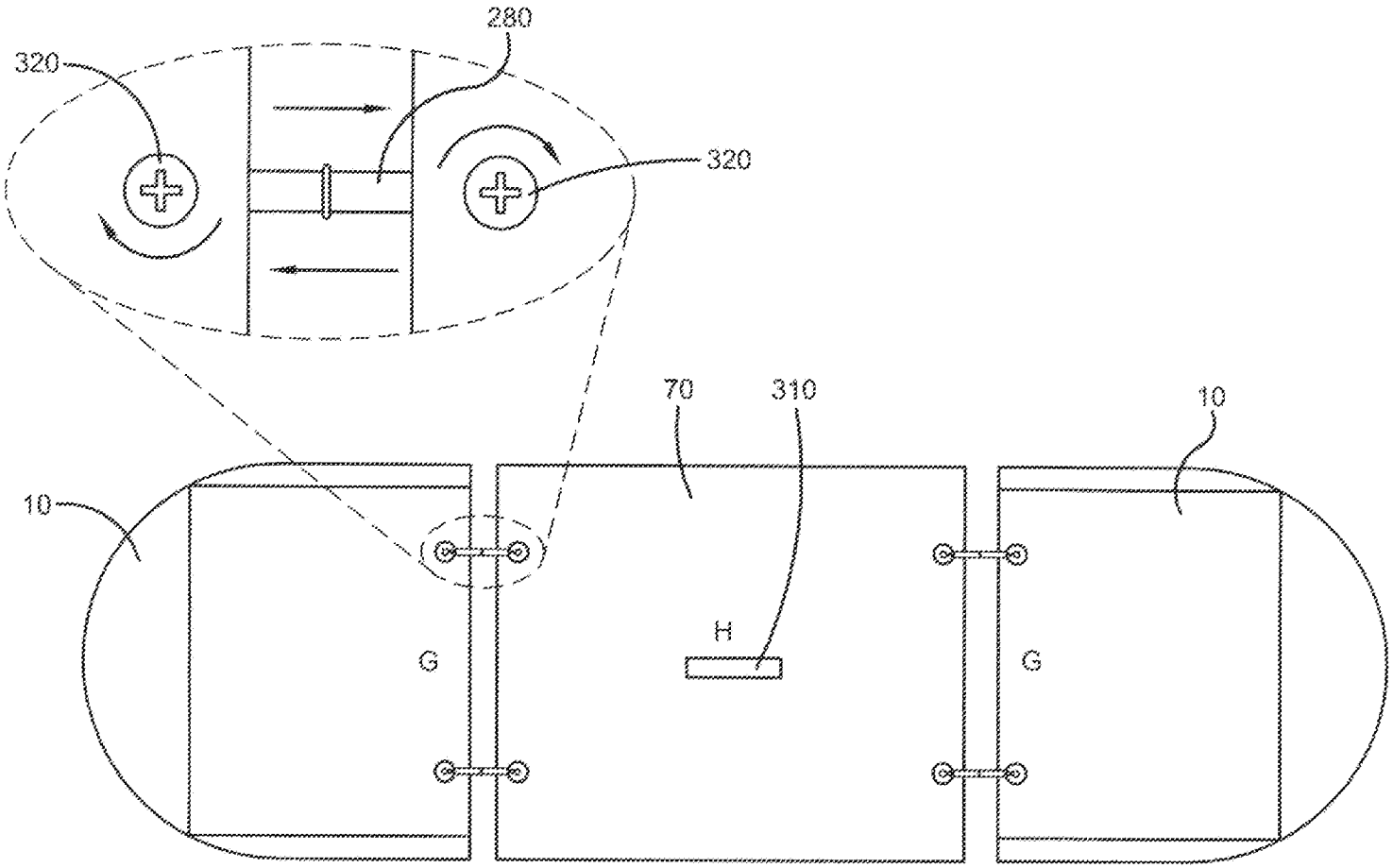
FIG. 6 is an exploded view of the elongated work surface.
Figure 7:
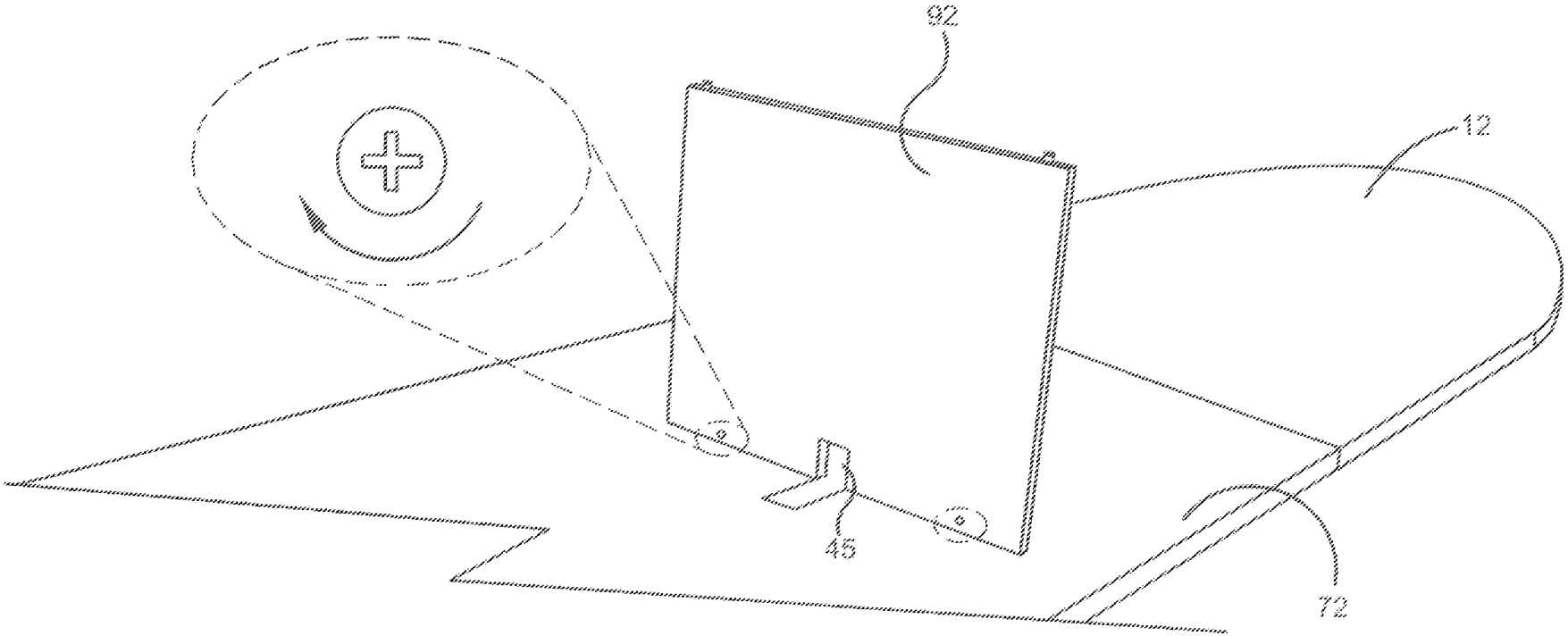
FIG. 7 is a detailed view of the modular conference table.
Figure 8:
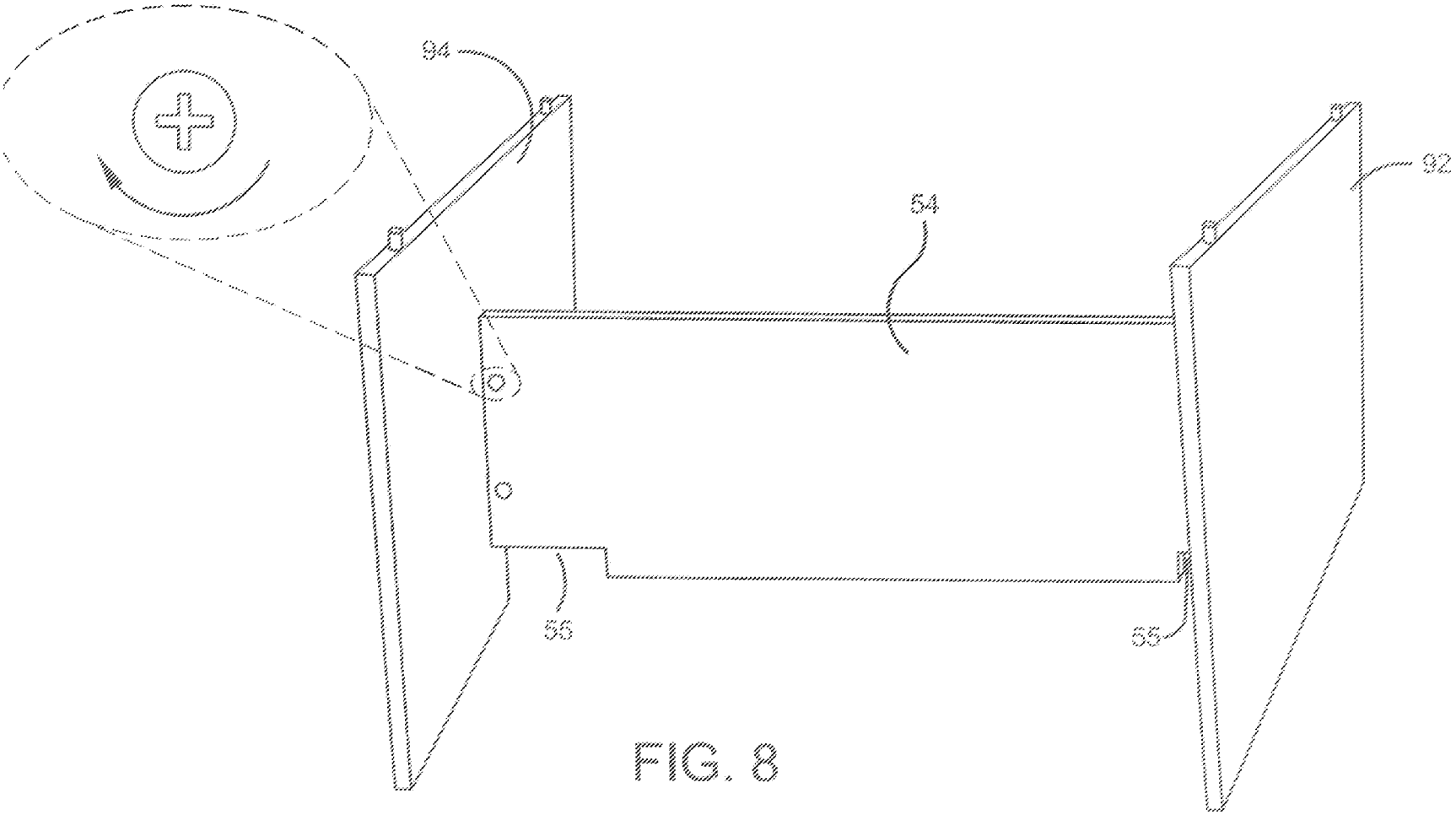
FIG. 8 is a front perspective view of the support assembly.
Figure 9:
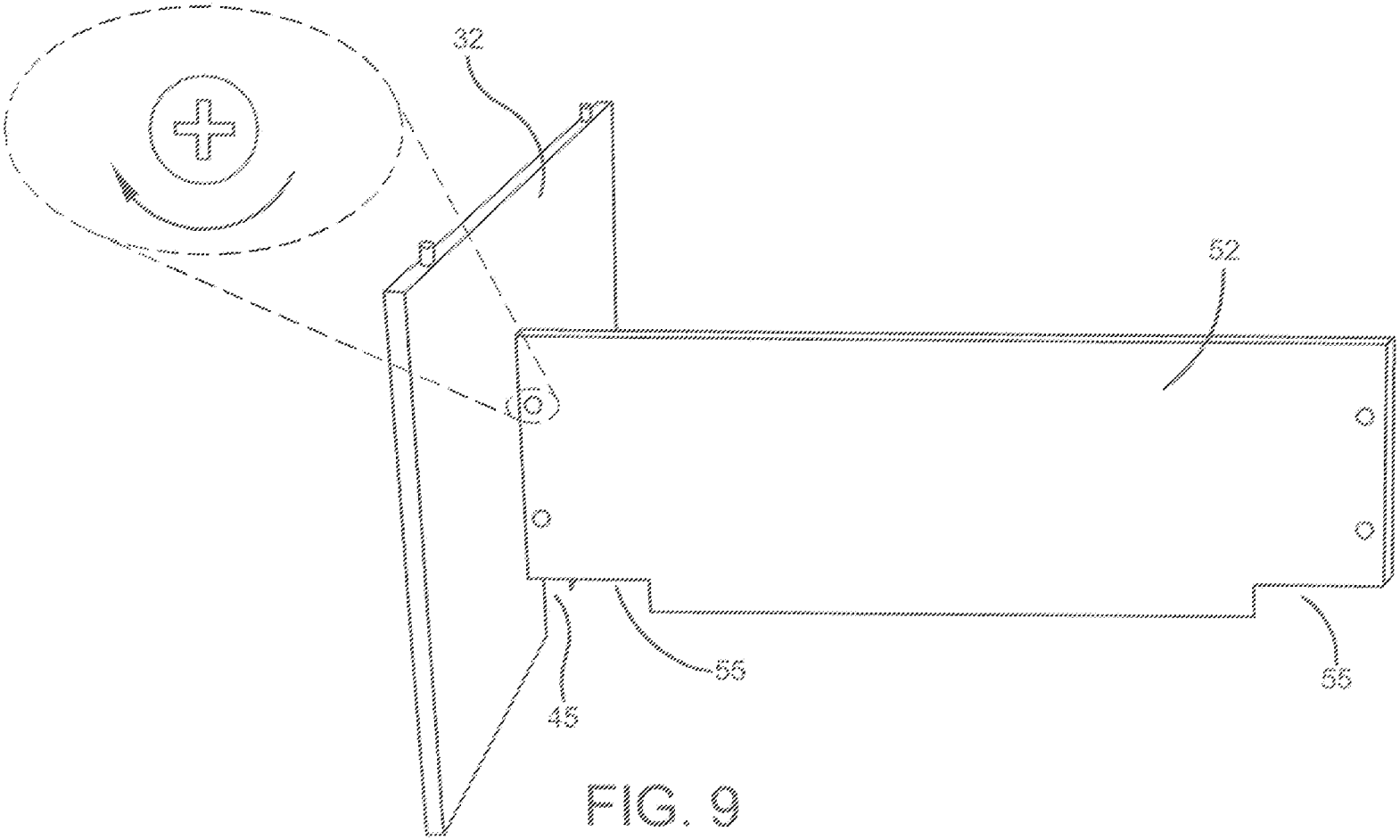
FIG. 9 is a detailed view of the support assembly.
Figure 10:
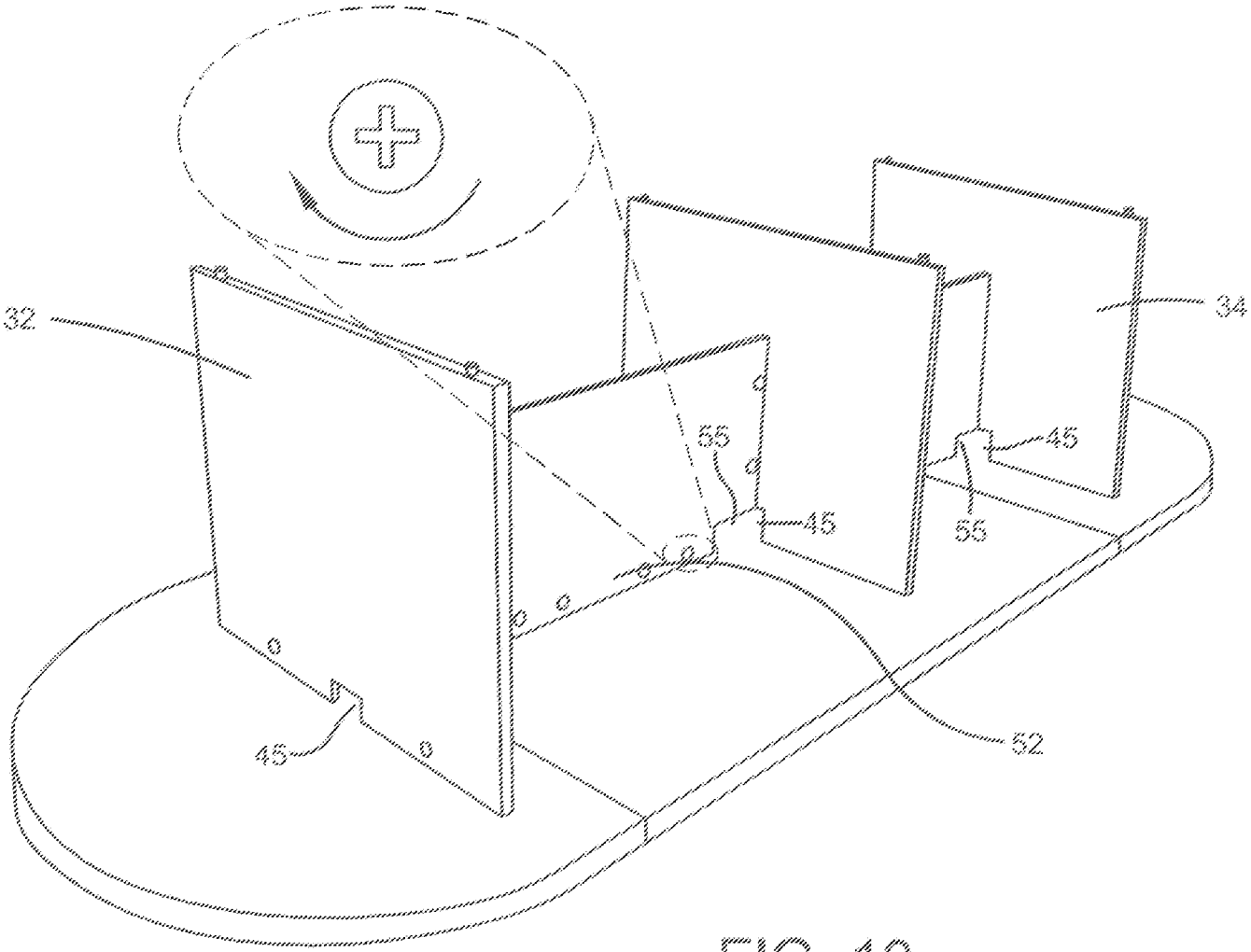
FIG. 10 is a perspective view of the modular conference table.

With reference now to FIGS. 6-10, the FIGURES show the attachment of the various parts, using the hardware shown in FIG. 3. FIG. 5 shows the attachment points for the modesty panels 50 and supports 30 to the underside 10 of the table 220. FIG. 6 shows and exploded view of one embodiment of the connection of the end tops 12, 14 to the insert top 70, using cam locks 320. FIG. 7 shows an exploded view of the connection of the center support 92 to the insert top 72 using cam lock 320. FIGS. 8-10 show the connection of the center supports 92, 94 to the modesty panel 54 using cam locks 320. It is to be understood, however, that any means of connecting the various pieces together can be used, as long as chosen using sound engineering judgment.

Figure 12:
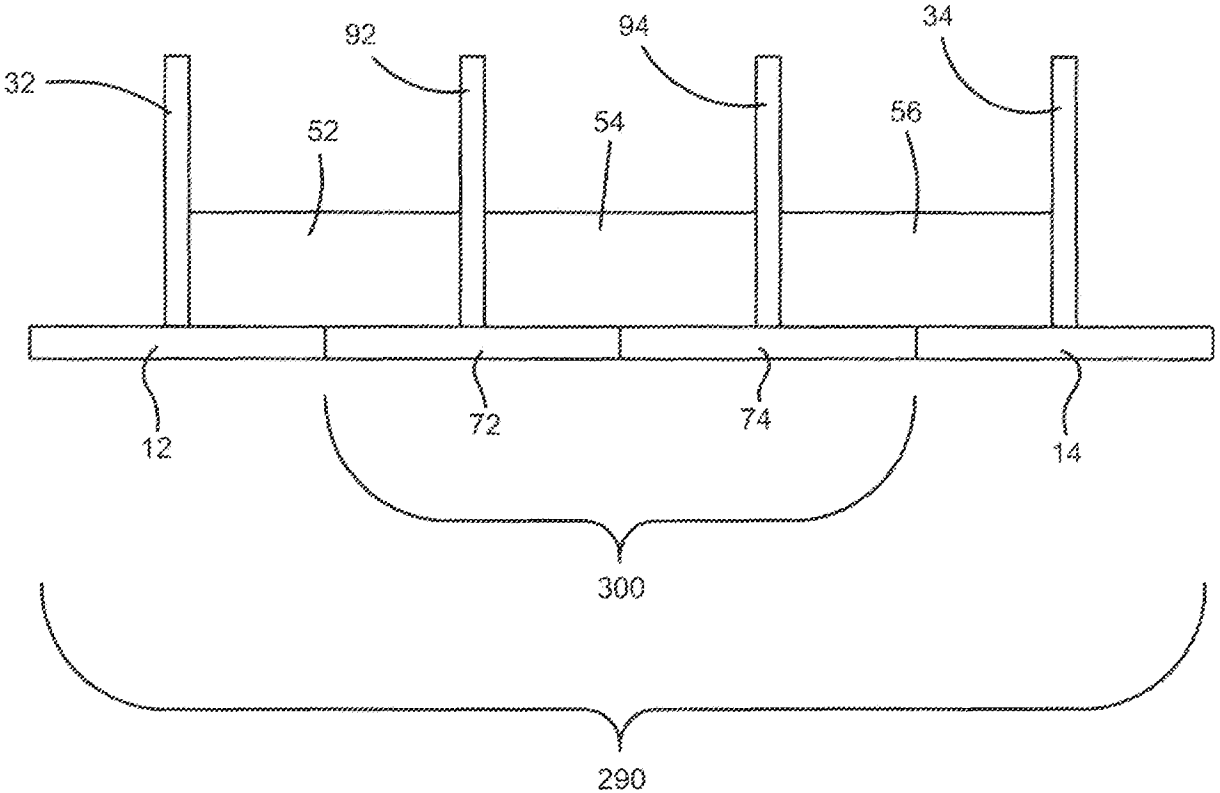
FIG. 12 is a side view of the modular conference table.

Referring now to FIGS. 11 and 12, which illustrate another embodiment, the modular conference table 220 includes a tabletop assembly 290, a leg assembly, and at least three modesty panels 52, 54, 56. The tabletop assembly 290 includes a first end-top 12, a second end-top 14 and at least two modular insert tops 72, 74. The modular insert tops 72, 74 are aligned with one another to form an inner tabletop assembly 300 where the inner tabletop assembly 300, formed by the two modular insert tops 72, 74, is interposed between the first and second end-tops 12, 14 to form an elongated work surface. The first and second end-tops 12, 14 are positioned at opposite ends of the inner tabletop assembly 300 such that the inner tabletop assembly 300 and the first and second end-tops 12, 14 are abutted end-to-end with each other and are aligned to form the elongated work surface 290. The leg assembly upholds the tabletop assembly. The leg assembly includes a first terminal support 32, a second terminal support 34, and at least two center supports 92, 94. The first terminal support 32 is perpendicularly attached to the first end-top 12. The second terminal support 34 is perpendicularly attached to the second end-top 14. The two center supports 92, 94 are interposed between the terminal supports 32, 34 and are perpendicularly attached to each modular insert top 72, 74. The modular conference table 220 also includes at least three modesty panels 52, 54, 56. Each modesty panel is perpendicularly attached to the elongated work surface 290.

Figure 13:
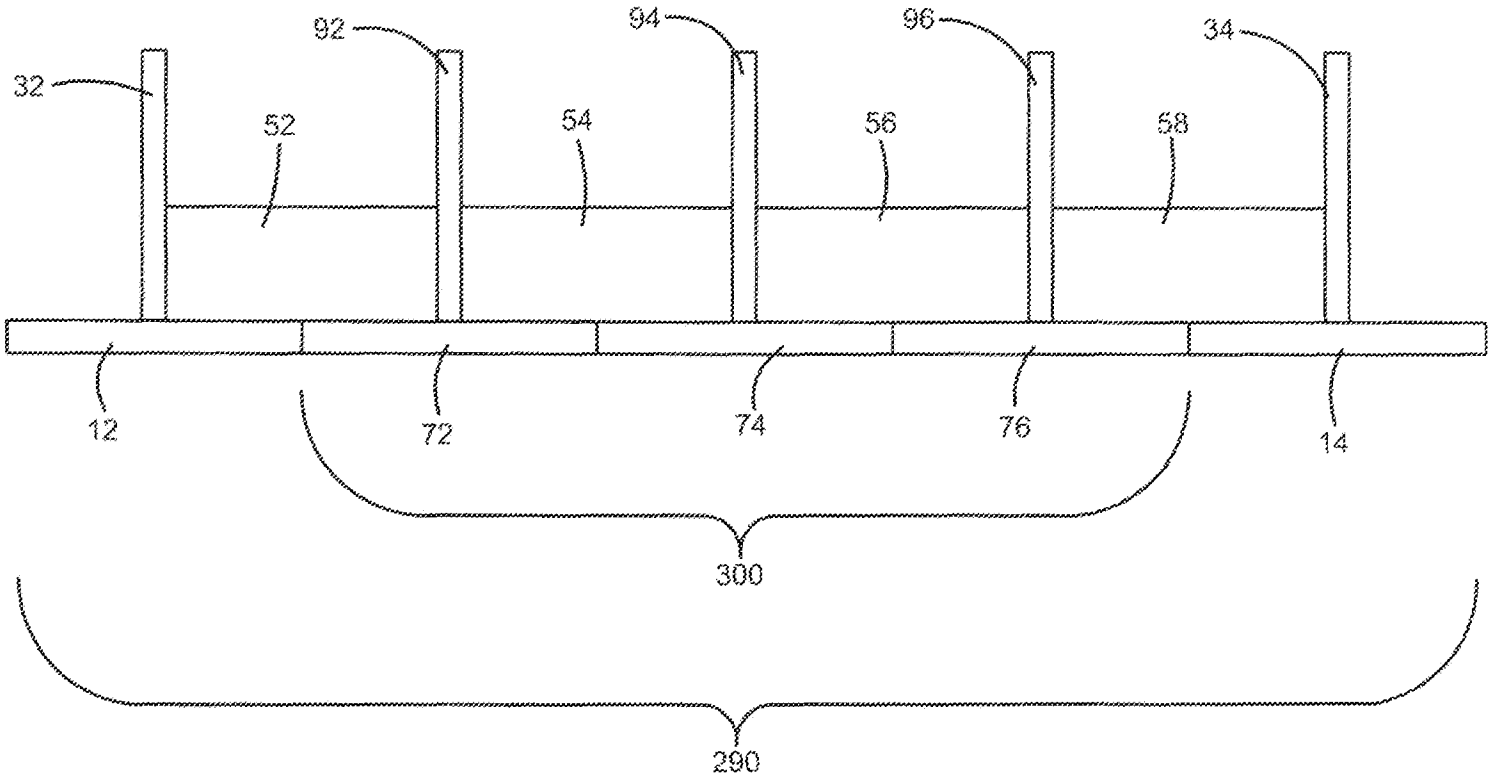
FIG. 13 is a side view of the modular conference table.

Referring now to FIG. 13 which illustrates yet another embodiment of this invention, the modular conference table 220 includes a tabletop assembly, a leg assembly, and at least four modesty panels 52, 54, 56, 58. The tabletop assembly includes a first end-top 12, a second end-top 14 and at least three modular insert tops 72, 74, 76. The modular insert tops 72, 74, 76 are aligned with one another to form an inner tabletop assembly 300 where the inner tabletop assembly 300 formed by the three modular insert tops 72, 74, 76 is interposed between the first and second end-tops 12, 14 to form an elongated work surface 290. The first and second end-tops 12, 14 are positioned at opposite ends of the inner tabletop assembly 300 such that the inner tabletop assembly 300 and the first and second end-tops 12, 14 are abutted end-to-end with each other and are aligned to form the elongated work surface 290. The leg assembly upholds the tabletop assembly. The leg assembly includes a first terminal support 32, a second terminal support 34, and at least three center supports 92, 94, 96. The first terminal support 32 is perpendicularly attached to the first end-top 12. The second terminal support 34 is perpendicularly attached to the second end-top 14. The three center supports 92, 94, 96 are interposed between the terminal supports 32, 34 and are perpendicularly attached to each modular insert top 72, 74, 76. The modular conference table 220 also includes at least four modesty panels 52, 54, 56, 58. Each modesty panel is perpendicularly attached to the elongated work surface 290.

Figure 14:
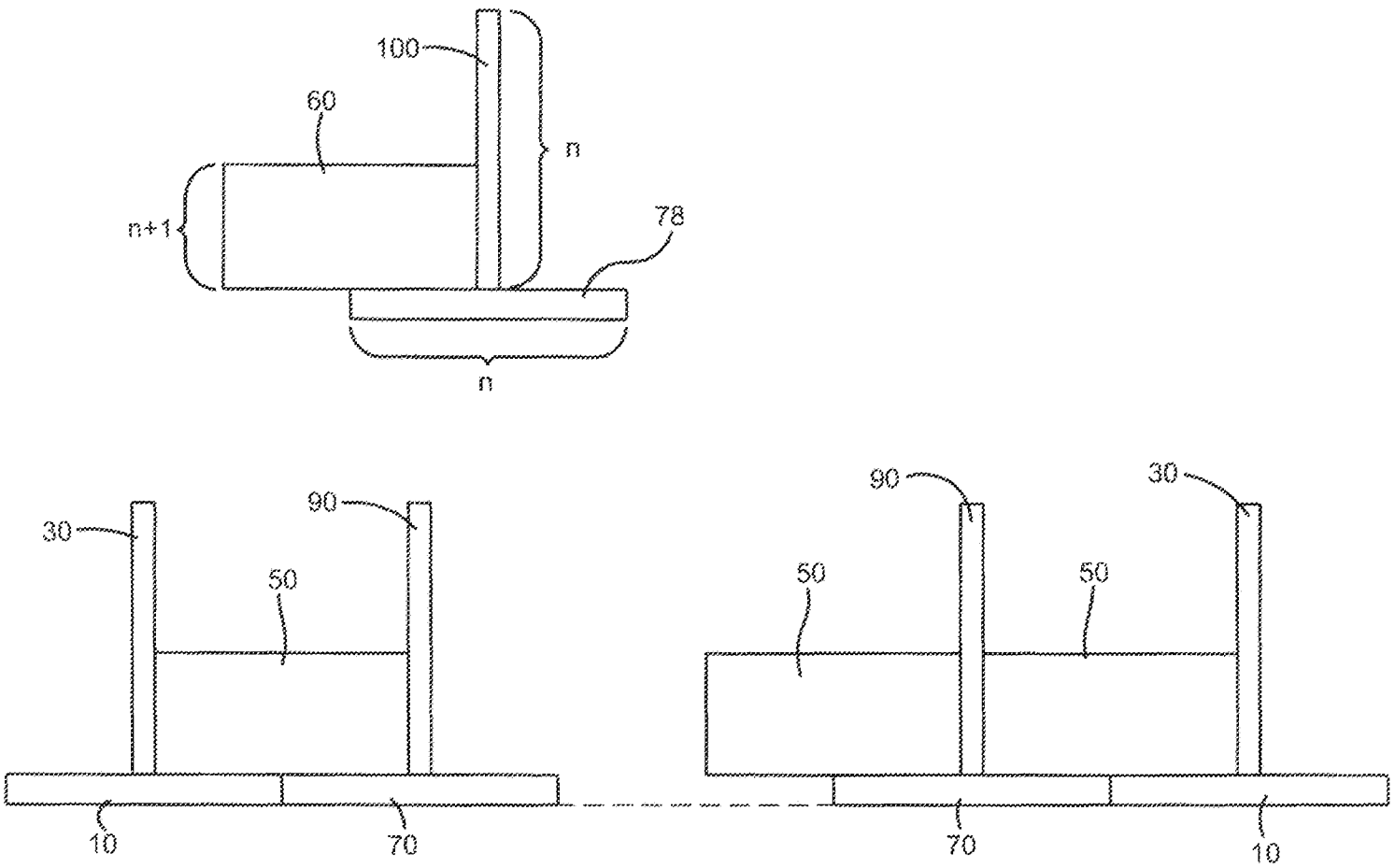
FIG. 14 is a side view of the modular conference table.

Referring now to FIG. 14 the present invention can be expanded in order to accommodate the needs of the user by adding an additional number of modular insert tops, modesty panels, and center supports. Thus, the invention described above can be expanded where the number n is equal to the number of modular insert tops and center supports desired and the number n+1 is the number of modesty panels needed. Upon reading and understanding this detailed specification, one of ordinary skill in the art could make the expansion of the current invention described above by adding the first, second, and third through the nth modular insert top 78, the first, second, and third through the nth center support 100, and the first, second, third, and fourth through the (n+1)th modesty panel 60.

According to yet another embodiment, a method may comprise the following steps. First, referring to FIGS. 4, 5, and 15, the cam pins 250, dowel rods 260, and double cam pins 280 are inserted into existing holes 210 in the first and the second terminal support 32, 34, the first and the second end-top 12, 14, the first and the second modular insert top 72, 74, and the alpha, beta, and gamma modesty panels 52, 54, 56. In another embodiment, a bracket 330 can be used on the bottom of the first and second end-tops 12, 14, towards the outer edges where the tops 12, 14 meet, to aid the double cam pins to join together the top sections 12, 14. Second, referring to FIGS. 6 and 12 the first and second modular insert tops 72, 74 are attached to one another such that each modular insert top is abutted end-to-end with the other and is aligned to form an inner tabletop assembly 300. Then the associated cam locks 320 are tightened. Next, the first and second end-tops 12, 14 are attached to opposite ends of the inner tabletop assembly 300 such that the inner tabletop assembly 300 and the first and second end-tops 12, 14 are abutted end-to-end with each other and are aligned to form an elongated work surface.

Figure 15:
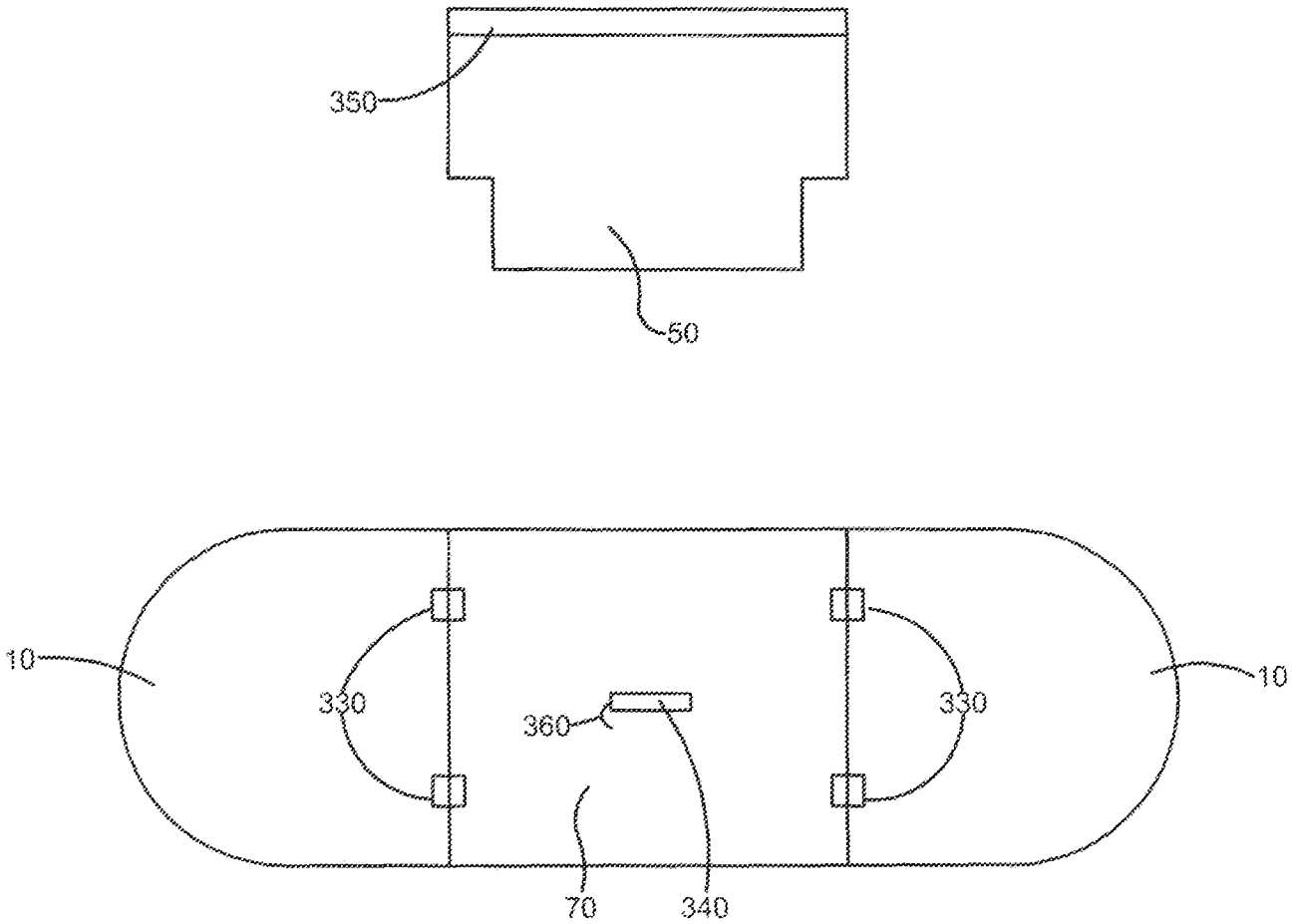
FIG. 15 is an exploded view of the underside of the modular conference table.

Referring to FIGS. 7 and 15, the first center support 92 is attached to the first modular insert top 72 and the associated cam locks 320 are tightened. Referring to FIG. 8, the alpha modesty panel 52 is attached to the first center support 92 and the first and second insert tops 72, 74 and the associated cam locks 320 are tightened. Then the second center support 94 is attached to the second insert top 74. Referring to FIG. 9, the gamma modesty panel 56 is attached to the second center support 94, the second insert top 74, the second end-top 14 and the associated cam locks 320 are tightened. Referring to FIG. 10, the second terminal support 34 is attached to the second end-top 14 and the associated cam locks 320 are tightened. Next, the alpha modesty panel 52 is attached to first center support 92, the first insert top 72, and the first end-top 12 and the associated cam locks 320 are tightened. Finally the first terminal support 32 is attached to the first end-top 12 and the associated cam locks 320 are tightened. Optionally, the cam locks 320 can be covered with cam caps 270. Additionally grommet 200 may be inserted into the elongated central opening 310. An optional power supply 350 can be provided to fit into the grommet 200. In this embodiment, at least one wire management trough 340 is attached to the top edge of the modesty panels 52 and is used to hide and manage wires 360 from the grommet 200 to the floor. It is to be understood that the various parts and there connectivity are not limited to the manner of connection in this paragraph. It is to be understood that any mechanism for connecting the supports, tops, and panels can be used, as long as chosen using sound engineering judgment.

The embodiments have been described, hereinabove. It will be apparent to those skilled in the art that the above methods and apparatuses may incorporate changes and modifications without departing from the general scope of this invention. It is intended to include all such modifications and alterations insofar as they come within the scope of the appended claims or the equivalents thereof. Although the description above contains much specificity, this should not be construed as limiting the scope of the invention, but as merely providing illustrations of some of the presently preferred embodiments of this invention. Various other embodiments and ramifications are possible within its scope.

Furthermore, notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements.

What is claimed is:

1. A modular table assembly assembled from modules, said modular table assembly comprising:

an inner tabletop assembly comprised of an n number of center supports, which includes an n=1 center support; an n number of modular insert tops, which includes an n=1 modular insert top, wherein each modular insert top has a modular insert top surface and a modular insert bottom surface, with n being an integer greater than 0, such that when n is greater than 1, each n number of modular insert tops is aligned adjacent to at least one other modular insert top to form the inner tabletop assembly, wherein each one of the center supports is attached perpendicularly to the bottom surface of a separate one of the modular insert tops, and each modular insert top has a distance across the modular insert top which is in a direction perpendicular to the center support attached to the bottom surface of the modular insert top;

said inner tabletop assembly interposed between a first end top abutted to a first end of the inner tabletop assembly, and a second end top abutted to a second end of the inner tabletop assembly wherein the first end of the inner tabletop assembly and the second end of the inner tabletop assembly are opposite ends of the inner tabletop assembly; said first end top having a first end top surface and a first end top bottom surface attached perpendicularly to a first terminal support with said first end top having a distance across the first end top which is in a direction perpendicular to the first terminal support; said second end top having a second end top top surface and a second end top bottom surface attached perpendicularly to a second terminal support with said first end top having a distance across the second end top which is in a direction perpendicular to the second terminal support; and n+1 modesty panels; wherein when n=1, there is a first modesty panel interposed between and perpendicular to the first terminal support and the n=1 center support, extending from the first terminal support to the first center support, and attached to the n=1 modular insert top and the first end top, a second modesty panel interposed between and perpendicular to both the second terminal support and the n=1 center support extending from the second terminal support to the n=1 center support, and attached to the n=1 modular insert top and the second end top; and when n>1 there is a first modesty panel interposed between and perpendicular to both the first terminal support and a first center support, extending from the first terminal support to the first center support, and attached to a first modular insert top and the first end top, a second modesty panel interposed between and perpendicular to both the second terminal support and a second center support extending from the second terminal support to the second center support, and attached to a second modular insert top and the second end top with the other n+1 modesty panels individually interposed between center supports of adjacent modular insert tops and attached to the adjacent modular insert tops; and wherein each modesty panel between two center supports extends a full distance between each of the two center supports.

2. The modular table assembly of claim 1, wherein when n>1, the distances across each of the modular insert tops are substantially equal, and the distance across the first end top and the distance across the second end top are substantially equal to the distance across any of the modular insert tops; and when n=1, the distance across the first end top and the distance across the second end top are each substantially equal to the distance across the n=1 modular insert top.

3. The modular table assembly of claim 1, wherein when n>1, the distances across each of the n modular insert tops are substantially equal, and the distance across the first end top and the distance across the second end top are not substantially equal to the distance across any of the modular insert tops; and when n=1, the distance across the first end top and the distance across the second end top are each not substantially equal to the distance across the n=1 modular insert top.

4. A table comprising:

a substantially planar top surface, wherein the top surface includes two non-contiguous end portions; two terminal supports respectively extending perpendicular from the two non-contiguous end portions;

a first insertable top portion assembly comprising: a first insertable top portion, a first center support, a first modesty panel, and a second modesty panel, wherein the first modesty panel and the second modesty panel extend downwardly from an underside of the top portion, the first center support extends perpendicularly from the top portion, and is substantially in the center of the insertable top portion, positioned between the first modesty panel and the second modesty panel;

at least one second insertable top portion assembly comprising: a second insertable top portion, a third modesty panel, and a second center support, wherein the second center support extends perpendicularly from the insertable top portion of the at least one second insertable top portion assembly and is substantially in the center of the second insertable top portion of the at least one second insertable top portion assembly wherein the third modesty panel extends downwardly from an underside of the second insertable top portion of the at least one second insertable top portion assembly;

wherein the insertable top portions of the first and the at least one second insertable top portion assemblies are between the two non-contiguous end portions, wherein the insertable top portions of the first and at least one second insertable top portion assemblies and the two non-contiguous end portions form a substantially flat surface, wherein the insertable top portions of the first and second insertable top portion assemblies are removably attached to the two non-contiguous end portions; and wherein each modesty panel between two center supports extends a full distance between each of the two center supports.

* * * * *